US008888546B2

(12) United States Patent
Dykstra et al.

(10) Patent No.: US 8,888,546 B2
(45) Date of Patent: Nov. 18, 2014

(54) AQUATIC STABILIZING LOCUS PREVENTING ROVING

(71) Applicants: Cheryl Meares Dykstra, Largo, FL (US); Nancy Meares Kelly, Hernando, FL (US)

(72) Inventors: Cheryl Meares Dykstra, Largo, FL (US); Nancy Meares Kelly, Hernando, FL (US)

( * ) Notice: Subject to any disclaimer, the term of this patent is extended or adjusted under 35 U.S.C. 154(b) by 80 days.

(21) Appl. No.: 13/645,485

(22) Filed: Oct. 4, 2012

(65) Prior Publication Data

US 2013/0333606 A1 Dec. 19, 2013

Related U.S. Application Data

(60) Provisional application No. 61/546,595, filed on Oct. 13, 2011.

(51) Int. Cl.

| | |
|---|---|
| ***B63C 9/08*** | (2006.01) |
| ***B63B 21/00*** | (2006.01) |
| *B63B 21/29* | (2006.01) |
| *B63B 35/73* | (2006.01) |
| *B63B 21/20* | (2006.01) |
| *B63C 9/04* | (2006.01) |
| *B63B 21/04* | (2006.01) |

(52) U.S. Cl.

CPC ..... *B63B 21/00* (2013.01); *B63B 21/29* (2013.01); *B63B 35/73* (2013.01); *B63B 2021/203* (2013.01); *B63C 9/04* (2013.01); *B63B 21/04* (2013.01)

USPC ..... 441/129; 441/131

(58) Field of Classification Search

USPC ..... 114/230.2; 441/129, 130, 40, 6, 131

See application file for complete search history.

(56) References Cited

U.S. PATENT DOCUMENTS

| | | | | | |
|---|---|---|---|---|---|
| 3,093,848 | A | * | 6/1963 | Schick et al. | 441/26 |
| 4,729,331 | A | * | 3/1988 | Eggleston | 114/230.26 |
| 4,834,015 | A | * | 5/1989 | Alpert | 114/294 |
| 4,913,672 | A | * | 4/1990 | Martin | 441/40 |
| 5,203,860 | A | * | 4/1993 | Bollant | 441/40 |
| 5,273,473 | A | * | 12/1993 | Allen | 441/129 |

(Continued)

OTHER PUBLICATIONS

Associated Press, Jerry Whipple Drifts One Mile Into Gulf of Mexico on Pool Float Before Coast Guard Rescue, St. Petersberg Times article, Jun. 24, 2010, Florida available at www.huffingtonpost.com/2010/06/24/on-pool-float-jerry-whipp_n_623900.html.

(Continued)

*Primary Examiner* — Lars A Olson
*Assistant Examiner* — Jovon Hayes
(74) *Attorney, Agent, or Firm* — Lawrence J. Kelly

(57) ABSTRACT

Exemplary embodiments of a manufacture of an aquatic stabilizing locus inhibiting roving, comprising: a buoyant main body comprising; a top, sky-side, surface, a bottom, water-side, surface, at least one attachment loop secured to at least one attachment loop base; at least one water-side attachment loop, secured to at least one water-side attachment loop base; and at least one stabilizing line, wherein each end of the stabilizing line forms into fixed loops enabled to concatenate with at least one concatenation element, and wherein the stabilizing line is concatenated to the water-side attachment loop. Exemplary embodiments of means for inhibiting roving, of at least one object floating in an aquatic medium, by means of a stabilizing locus comprising: a means for providing buoyancy to the locus; a means for concatenating at least one device to the locus; a means for concatenating the locus to an object that inhibits locus aquatic roving.

18 Claims, 4 Drawing Sheets

(56) References Cited

U.S. PATENT DOCUMENTS

| | | | | |
|---|---|---|---|---|
| 5,410,981 | A * | 5/1995 | Gutstein et al. | 114/294 |
| 5,518,431 | A * | 5/1996 | Staley | 441/130 |
| 5,551,901 | A * | 9/1996 | Jaeger | 441/6 |
| 5,819,681 | A * | 10/1998 | Barnes et al. | 114/294 |
| D407,058 | S * | 3/1999 | Moldenhauer | D12/215 |
| 6,135,046 | A * | 10/2000 | Beech | 114/311 |
| 6,368,171 | B1 * | 4/2002 | Fuller et al. | 441/40 |
| 6,475,048 | B2 * | 11/2002 | Gredy | 441/129 |
| 6,508,682 | B1 * | 1/2003 | Clark | 441/40 |
| 7,165,505 | B2 * | 1/2007 | Franchetti | 114/345 |
| 7,867,049 | B1 * | 1/2011 | Doffay | 441/40 |
| 2007/0283868 | A1 * | 12/2007 | Hagan | 114/230.1 |
| 2011/0177732 | A1 * | 7/2011 | Clifford | 441/38 |
| 2013/0333606 | A1 * | 12/2013 | Dykstra et al. | 114/230.2 |

OTHER PUBLICATIONS

Xan Brooks, Porpoises Rescue Dick Van Dyke, The Guardian article, Nov. 11, 2010, United States edition, available at http://www.theguardian.com/film/2010/nov/11/dick-van-dyke-porpoises-rescue.

Nite-ize S-Biner #10 Orange Plastic Carabiner, Camping Gear Outlet Catalog, available at http://www.camping-gear-outlet.com/camping-gear-296997.html.

* cited by examiner

FIG. 2A
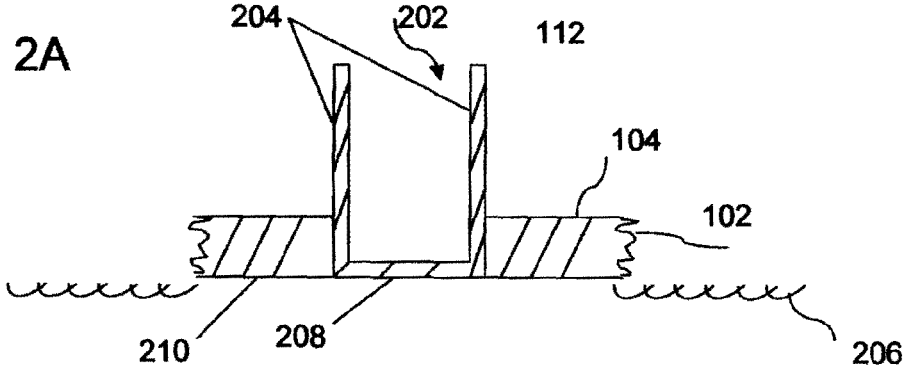
FIG. 2B
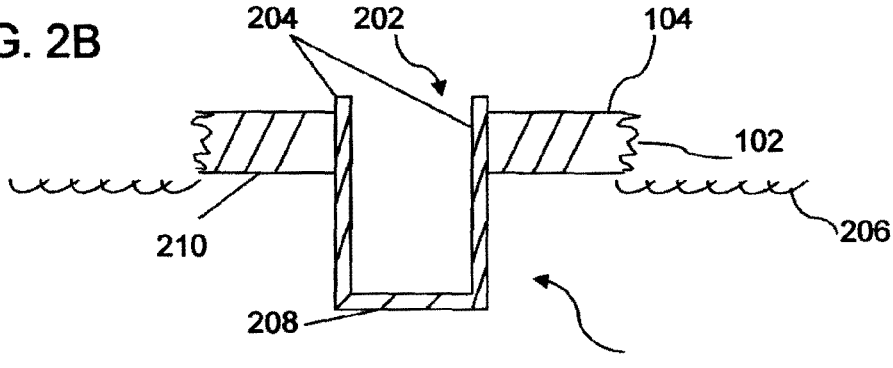
FIG. 2C
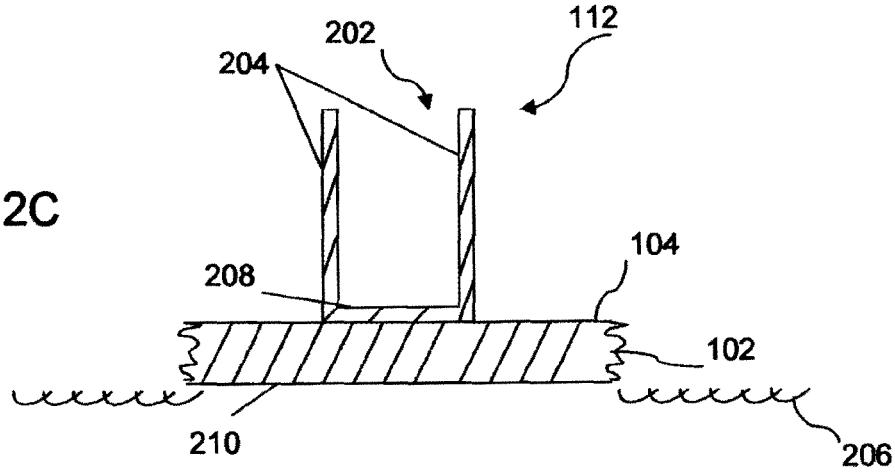
FIG. 2

FIG. 4A
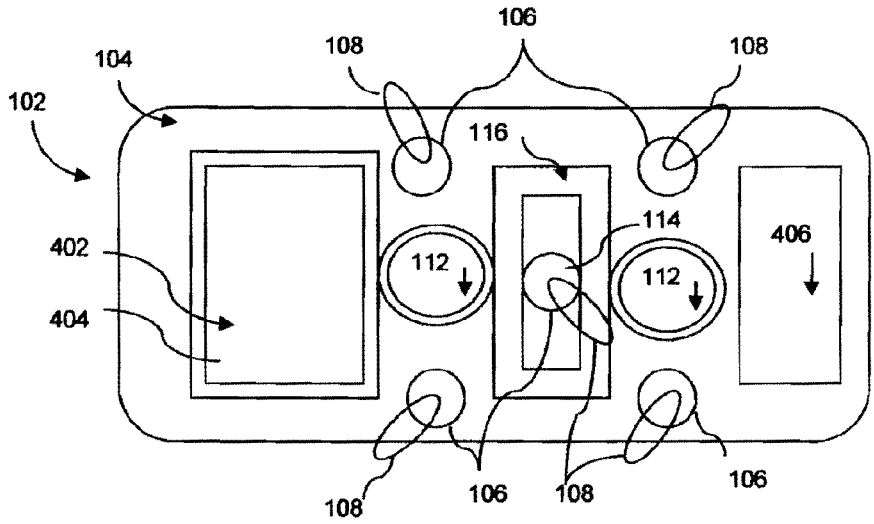
FIG. 4B
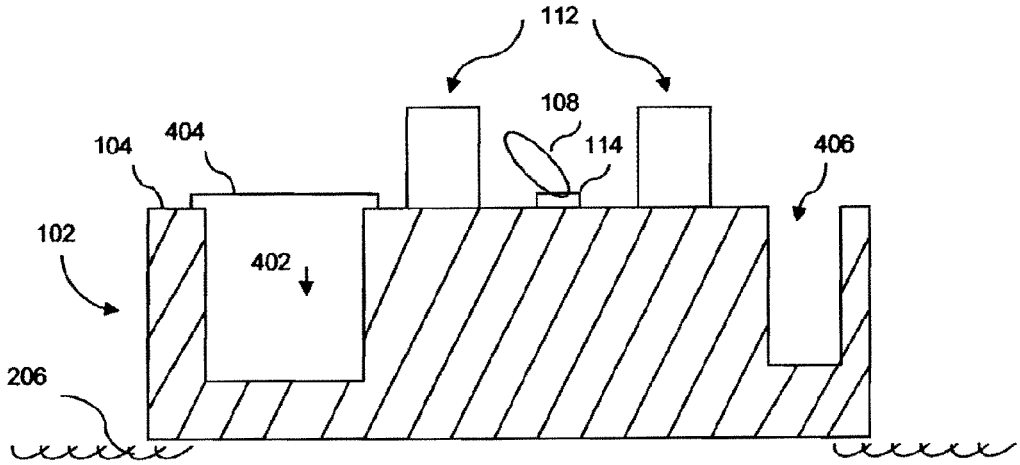
FIG. 4

AQUATIC STABILIZING LOCUS PREVENTING ROVING

CROSS-REFERENCES TO RELATED APPLICATIONS

This non-provisional application claims a right of priority for benefit of the earlier filing date of Oct. 13, 2011 of provisional application 61/546,595 on the same subject matter by the same inventors as for this non-provisional application.

STATEMENT REGARDING FEDERALLY SPONSORED RESEARCH

Not Applicable.

NAMES OF PARTIES TO A JOINT RESEARCH AGREEMENT

Not Applicable.

INCORPORATION-BY-REFERENCE OF MATERIAL SUBMITTED ON A COMPACT DISC

Not Applicable.

BACKGROUND

The "Technical Field" relates to a manufacture and means for providing a stabilizing locus, capable of hosting attached items, inhibiting roving in an aquatic environment.

Related "Background Art" includes press articles describing injury, death, or required rescue of aquatic recreationists resting on buoyant devices that were not inhibited from roving away from shallow waters and safe shores. Sometimes the perilous roving was caused by overpowering currents or winds, but often it occurred in milder conditions due to the recreationist's inattention or slumber. Previous devices attempting to minimize the perils of aquatic roving used anchors integrated into customized individual aquatic flotation devices. Some previous devices incorporate a weighted anchor which must be stored when not in use and whose bulk and weight must be transported from a place of storage to the use location, or whose weight and bulk create difficulties in deflating and transporting or storing the attached individual floatation device. Some such devices required the individual floats to be constructed with reinforced grommets or specialized connection areas built into the raft, which did not provide anchoring for any individual float not constructed in the specialized manner. Some previous devices require components made of brass. Further, individual rafts with integral anchors did not facilitate connecting or stabilizing a multiplicity of potentially varying styles and construction of anchorless floats about a single locus. Some previous related devices do not attempt to stabilize flotation devices in a fixed location, but merely attempt to slow the drift rate or wave induced pitching of a raft or watercraft. Some previous devices contain metal components susceptible to corrosion and rust, such as springs or clips. Some previous related devices used suction cup type devices to couple a personal flotation device to swimming pool side tiles or boat hulls. Some related previous devices are designed for use only in swimming pools, and not out in open waters. Some previous devises only claim function in lakes or ocean waters.

BRIEF SUMMARY

Exemplary embodiments of a manufacture of an aquatic stabilizing locus inhibiting roving are presented. The manufacture of a buoyant main body comprising; a top, sky-side, surface, a bottom, water-side, surface, at least one attachment loop secured to at least one attachment loop base, wherein the attachment loop base may be located on the top, sky-side, surface of the main body; at least one water-side attachment loop, secured to at least one water-side attachment loop base, wherein the water-side attachment loop base may be located on the bottom, water-side, surface of the main body; and at least one stabilizing line, wherein each end of the stabilizing line forming into fixed loops enabled to concatenate with at least one concatenation element, and wherein the stabilizing line is concatenated to the water-side attachment loop by at least one concatenation element, and at least one additional concatenation element is concatenated to the end of the stabilizing line not concatenated to the water-side attachment loop on the main body is shown. Exemplary embodiments of means for inhibiting roving, of at least one object floating in an aquatic medium, by means of a stabilizing locus comprising: a means for providing buoyancy to the locus; a means for concatenating at least one device to the locus; and a means for concatenating the locus to an object that inhibits locus aquatic roving are shown.

BRIEF DESCRIPTION OF THE DRAWINGS

A better understanding of the disclosed embodiments may be obtained by reference to the following drawings when read in conjunction with the specification.

FIG. 2 is a cross-section drawing of various embodiments of a manufacture of an aquatic stabilizing locus inhibiting roving, wherein the main body is comprised of at least one receptacle. FIG. 2A illustrates the at least one receptacle with its side walls extending upward from the bottom, water-side, of the main body; FIG. 2B illustrates the side walls of the receptacle extending downward into the water below the main body; FIG. 2C illustrates the side walls extending upward from a base that is at or on top of the surface of the sky-side of the main body.

FIG. 4 is a plan view drawing 4A, looking down upon a top, sky-side, of a manufacture of an embodiment of an aquatic stabilizing locus inhibiting roving, and a cross-section drawing 4B of a side elevation of a portion of the main body are shown.

DETAILED DESCRIPTION

One should understand at the outset that although illustrative implementations of one or more embodiments are described below, the disclosed system and means for providing a stabilizing locus, enabled to host attached persons and personal equipment, resistant to roving in an aquatic environment, further embodiments may be implemented using any number of techniques, whether currently known or in existence. Reference to items in the singular may include those items in the plural and vice versa. The disclosure should in no way be limited to the illustrative implementations, drawings, and techniques illustrated below, but may be modified within the scope of the appended claims along with their full scope of equivalents.

FIGS. 1 through 4 disclose embodiments of a manufacture and means for providing a stabilizing locus, enabled to host at least one attached item such as, but not limited to, a personal floatation device or other buoyant equipment, inhibiting roving in any aquatic environment.

Figure 1:
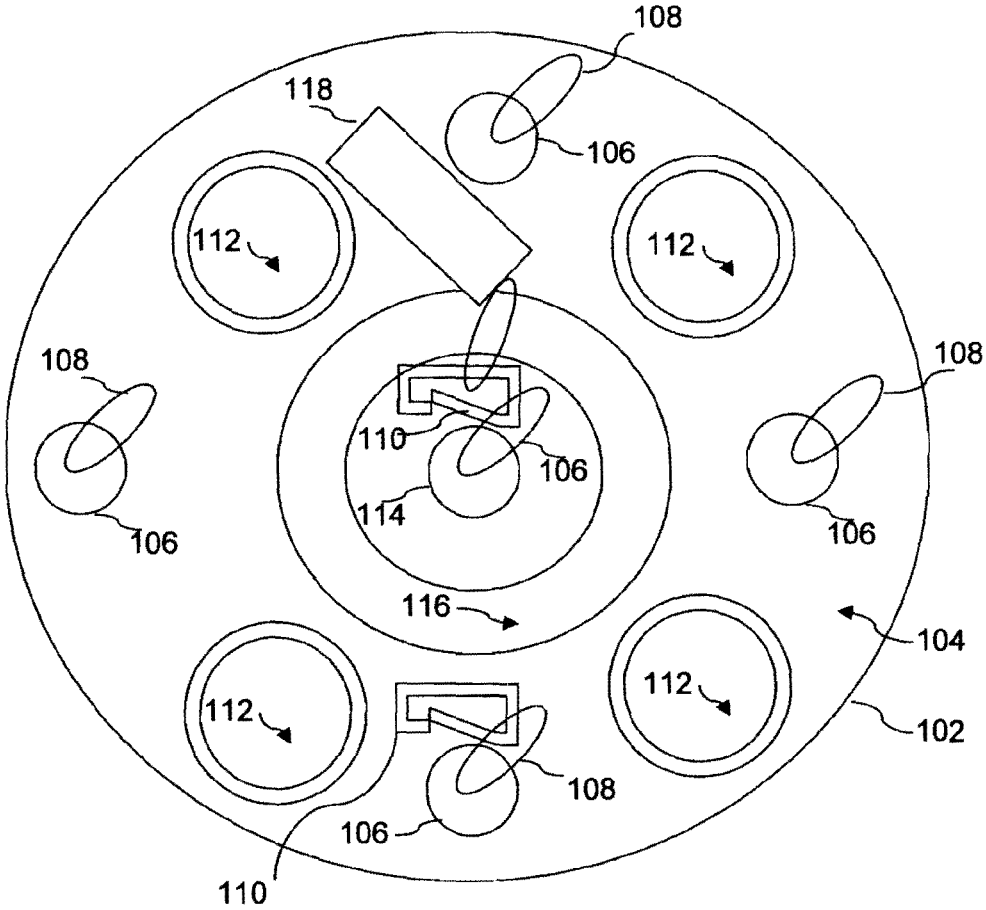
FIG. 1 is a plan view drawing of an embodiment of an aquatic stabilizing locus inhibiting roving.

FIG. 1 is a plan view drawing, looking down upon a top, sky-side, of a manufacture of an embodiment of an aquatic stabilizing locus inhibiting roving. The locus manufacture comprises a main body 102, comprising a top, sky-side 104, and a bottom, water-side (not shown in FIG. 1). Integrated upon, connected to, or adjacent to the surface of the top, sky-side 104, of the main body 102 is at least one attachment loop base 106 providing an attachment point to the main body 102 for at least one attachment loop 108. In some embodiments, the attachment loop 108 will have linked to the attachment loop 108 a detachable concatenation element 110 to enable concatenating, or linking, objects to the main body 102. If more than one attachment loop base 106 and attachment loop 108 are embodied, they need not be diametrically opposed. Also integrated within, connected to, or adjacent to the main body 102 in some embodiments may be at least one receptacle 112. The receptacle 112 need not be centrally disposed, circumferentially spaced, nor formed by radially extending vertical dividers. In some embodiments, as shown in FIG. 1, a central loop base 114 and an attachment loop 108 secured to the central loop base 114 are present in a central portion of the main body 102. In some embodiments, a detachable concatenation element 110 may be concatenated to the attachment loop 108 secured to the central loop base 114. In some embodiments, bounding or encircling the central loop base 114 is an adhesion zone 116 on the surface of the main body 102.

The main body 102 is constructed of a size, shape, and material that allow it to float in any body of water. The shape of the main body 102 may be circular, as shown in FIG. 1, or any geometric shape, or an irregular shape. As nonlimiting examples, in some embodiments the main body 102 shape could resemble some form of aquatic life, any animal, a popular figure, a recognizable landmark or building, or any representation desired. The thickness of the main body 102 may be narrow, such as the diameter of a United States quarter-dollar coin or smaller, or of a greater thicknesses that allows for integral storage capability for items such as, but not limited to, beverages, GPS tracking or signaling units, communication or entertainment devices, smokable products, reading materials, balls, whistles, sunglasses or goggles, snorkels, or the like. For any shape, the main body 102 will have a top, sky-side 104, whose surface is exposed primarily above the water surface and able to directly receive sun rays, and a bottom, water-side (not shown in FIG. 1), whose surface is primarily in contact with the water in which the main body 102 floats. In some embodiments, the main body 102 is constructed of light weight material, such as, but not limited to, aluminum, or a polymer-based product that will be easy for an individual to carry under an arm or in a bag. In some embodiments, the main body 102 may be comprised as a single buoyant object formed from a poured mold as is, or may become, known in the arts. In some embodiments the main body 102 may be formed comprised with embedded compartments, and or incorporate stringers, supports, or the like. In some embodiments, the main body 102 may be comprised of an assemblage of parts or pieces joined to form the main body 102, wherein the main body 102 is buoyant. In some embodiments the main body 102 will be comprised of a polymer composition. In some embodiments, the main body may be a tear-resistant water impermeable material, who's top, sky-side 104, and bottom, water-side, are joined in a manner to create an inflatable chamber that, when inflated, produces the shape and buoyancy of the main body 102. In some embodiments, most or all parts of the aquatic stabilizing locus inhibiting roving are constructed of materials that resist corrosion or deterioration in aqueous, salty, or sunny environments. In some embodiments, the exterior of the main body 102 may be coated with a durable paint or other coating as is, or may become, known in the art, such as but not limited to canvas, vinyl, or neoprene. While the main body 102 coatings may be in any desired color, in some embodiments the main body 102 coating will be in Sea Rescue Orange coloring, or colored flamingo pink, or any high visibility color or other design suitable for visually locating the main body 102 in the water, or for quickly distinguishing one main body 102 from others that may be located near by.

The attachment loop base 106 provides a reinforced area integrated upon, connected to, or adjacent to the surface of the top, sky-side 104, of the main body 102 for attachment of at least one attachment loop 108. As a nonlimiting example, the attachment loop base 106 may be similar in composition and installation to leash anchors commonly used on bodyboards such as an RFC Bodyboard Leash Plug. The attachment loop 108 may be of any durable material as is, or may become, known in the art and may be resistant to corrosion or deterioration in water, salt, or sunny environments. One nonlimiting example may be Dyneema fiber. In some embodiments, concatenated to the attachment loop 108 will be any concatenation element 110 as is, or may become, known in the art, such as but not limited to one comprised of a corrosion resistant material like titanium, or of a durable plastic form of a clip or carabiner, or a strip of durable material with Velcro or snap type ability to form a secure closed link. As a nonlimiting example, the concatenation element 110 may be a Berkley Point model T0541-0001 Titanium Snap Carabiner, a Nite Ize S-Biner #10 Orange Plastic Carabiner, or a Velcro type band similar to those on boogie board attachment straps such as, but not limited to, the Rax Surf RAX-4210 Bodyboard Wrist Leash. No suction cup mechanism serves as the concatenation element 110. The attachment loop 108 must be of a long enough length to form a loop perimeter that enables tying on rope, cord, line, shoelace, or any like means of connecting floatation devices or storage cases, or for accepting engagement with a concatenation element 110. Any buoyant object that can have a line, cord, rope, shoelace or the like secured to itself, can be attached to any attachment loop 108 by tethering onto the attachment loop 108 itself, or by tethering or linking onto the concatenation element 110 linked to the attachment loop 108. In some embodiments, the attachment loop 108 may have a coating to reduce friction and minimize wear, such as may be caused by translations of attached lines or of the at least one concatenation element 110. In some embodiments, the central attachment loop base 114, attachment loop 108, and concatenation element 110 may also be positioned in the center region of the main body 102, enabling the main body 102 to accommodate tethering or concatenating at least one object or storage bin 118, which may or may not be buoyant, but is of a size and weight that is small and light enough to rest upon the top, sky-side 104, of the main body 102 without causing the main body 102 to submerse.

The adhesion zone 116 provides a means to attach decorative, identifying, protective, or other modifications to the top, sky-side 104, of the main body 102. The adhesion zone 116 may be of various shapes and sizes, formed continuously, or segmented. As shown in the embodiment of FIG. 1, the adhesion zone 116 may be a circular ring, or it may be a series of aligned arcs made of Velcro type hooks capable of adhering to any object with an exterior portion of Velcro type fabric. Nonlimiting objects that might have exterior portions of Velcro type fabric on an exterior portion may include at least one of: a decorative item, an identifying item, a protective item, an entertainment item, an advertising item, a communication item, and a rescue item.

Examples of objects adhering to the adhesion zone 116 could include, but are not limited to: decorative items; a camera; a radio; a plastic sports or action figure; a horn, noise making, or signaling device; the base of a small plastic company or sports team logo, product, or pennant; or a dome that would minimize sun, wind, and or sea spray impact on items resting beneath it on the top of the main body 102. The exterior of such a dome may be decorated with any color or graphics desired to enhance spotting or identifying the individual stabilizing locus and its owner. In some embodiments such a dome may be buoyant. The adhesion zone 116 may comprise at least one corrosion resistant snap, or any other manner of adhesion, functional in aquatic environments, as is, or may become known, in the art.

Now looking at FIG. 2, a cross-section drawing of a side elevation of a portion of the main body 102 housing at least one receptacle 112 is shown. The at least one receptacle 112 provided has an opening 202 accessible from the top, sky-side 104, of the main body 102, side walls 204 approximately orthogonal to the surface of the water 206, and a base 208 approximately parallel to the surface of the water. The receptacle 112 may be located at any position on the main body 102. A multiplicity of receptacles 112 on the main body 102 may be of similar or of distinct perimeter shapes and sizes. The receptacle 112 may be of various shapes and heights enabled to accommodate various sized containers, such as but not limited to beverage cans or bottles. In some embodiments, the side walls 204 of the receptacle 112 may extend upward from the bottom, water-side 210, of the main body 102 as shown in FIG. 2A. In some embodiments, the side walls 204 of the receptacle 112 may extend downward into the water below the main body 102 as shown in FIG. 2B. In some embodiments, the side walls 204 of the receptacle 112 may extend upward from a base 208 that is at or on top of the surface of the sky-side 104, of the main body 102 as shown in FIG. 2C. In some embodiments, the receptacle 112 may be integrally preformed into the main body 102. In some embodiments, the receptacle 112 may be permanently secured to the main body 102. In some embodiments, the receptacle 112 may be a cavity within the main body 102, or may occupy a void cut through the main body, sized to retain, by pressure fitting, a removable independent unit such as, but not limited to, a beverage koozie. In some embodiments, the independent unit may be secured within the cavity in the main body 102 with a water durable glue. In some embodiments, the sky-side 104 of the base of the receptacle 112 may have an adhesion element, such as but not limited to Velcro type hooks or snaps that can be mated to Velcro type fabric or snaps applied to the bottom of an independent unit, such as but not limited to, a koozie or beverage container, or a glass or cup. The main body 102 receptacle 112, whether formed as an integral part of the main body 102 or as independent unit that is pressure fit into the main body 102 cavity, may incorporate various devices as may be commonly known, or become known, in the art to effectuate retaining multiple different sized containers. Nonlimiting examples of such retention devices may include rubberized flaps, approximately parallel to the receptacle 112 base 208 and extending inward partially inward from the side walls 204 toward the center of the receptacle 112, or interior receptacle 112 side linings formed from sealed sacs partially filled with a gel or liquid that may be partially displaced within the sacs to accommodate various shapes inserted into the center of the receptacle 112, or the receiving surface of the receptacle 112 may be comprised of compressible celled material as is, or may become, known in the art.

Figure 3:
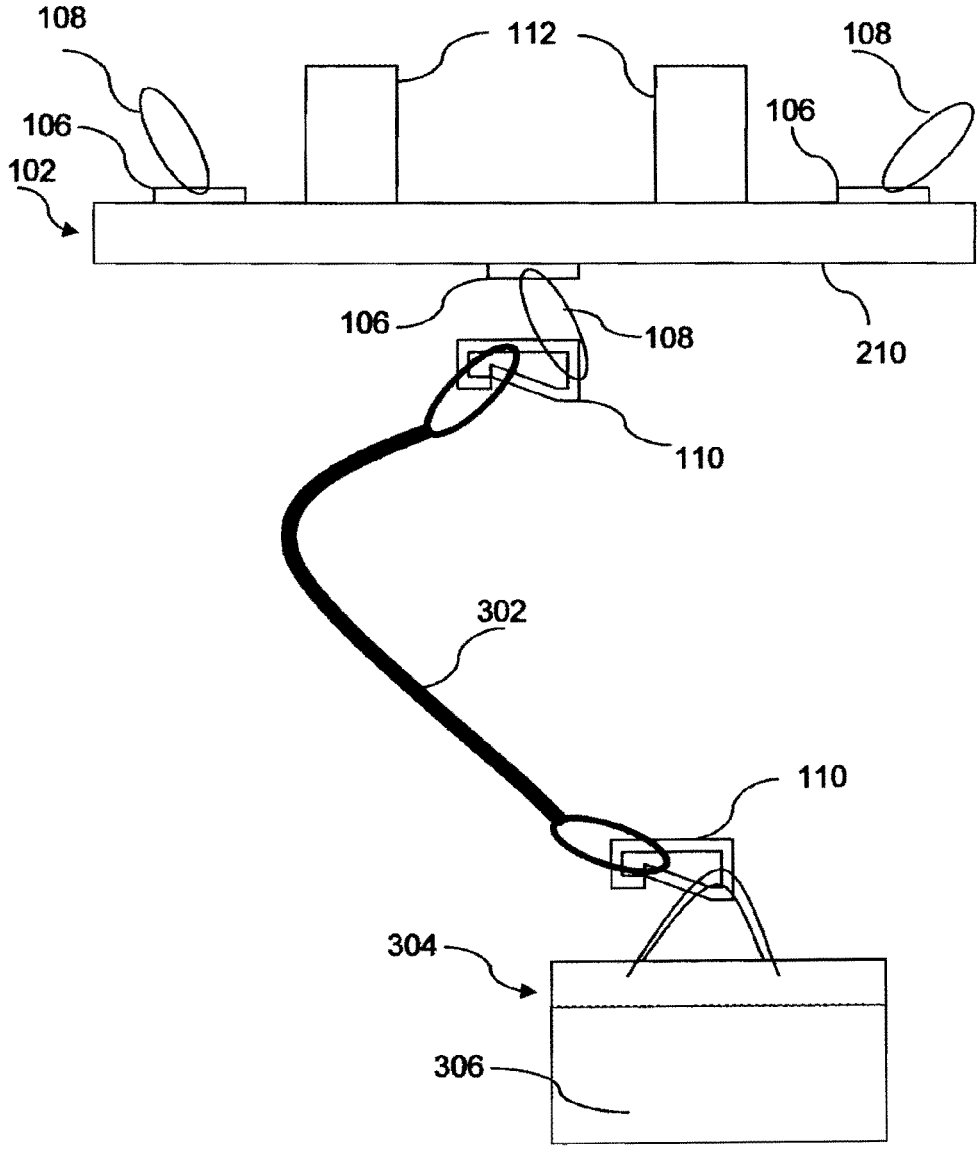
FIG. 3 is a side elevation drawing of an embodiment of a manufacture of an aquatic stabilizing locus inhibiting roving.

Now looking at FIG. 3, a side elevation drawing is shown of a manufacture of an embodiment of an aquatic stabilizing locus inhibiting roving. A main body 102 water-side 210 attachment loop base 106 is located in a central portion of the bottom, water-side 210, of the main body 102. The water-side 210 attachment loop base 106 may be located directly beneath the sky-side 104 central loop base 114. The water-side 210 attachment loop base 106 provides a reinforced area upon, connected, or adjacent to the main body 102 for attachment of at least one attachment loop 108. The water-side 210 attachment loop 108 may be of any durable material as may be known, or become known, in the art and may be resistant to corrosion or deterioration in water, salt, or sunny environments such as described above. In some embodiments, concatenated to the water-side 210 attachment loop 108 will be a concatenation element 110 as known, or may be known, in the art, such as described above.

Also concatenated onto the concatenation element 110 linked to the water-side 210 attachment loop 108 is a stabilizing line 302. The stabilizing line 302 may be comprised of any natural fiber or manmade material that is highly resistant to corrosion in aquatic and salty environments, such as but not limited to ropes common to nautical uses, or polymer based or synthetic formed cord, line, or rope. One example may be, but is not limited to, Dyneema fiber rope. Both ends of the stabilizing line 302 terminate in closed loops of sufficient size to easily accept linkage with common sized concatenation elements 110 as described above. The stabilizing line 302 may be of various fixed lengths from two to over ten feet, depending on the desired location or water depth for usage, or the stabilizing line 302 may benefit from knotting adaptations or from a retaining band as is, or may become, commonly known in the art for providing a line of adjustable length, such as but not limited to designs functioning like the Klein Tools' Nylon-Filament Rope Lanyard—Adjustable Length and Wire Pigtail. The closed loop at one end of the stabilizing line 302 is enabled to concatenate with the water-side 210 attachment loop 108 of the main body 102 utilizing at least one concatenation element 110. The other end of the stabilizing line 302 has at least one concatenation element 110 engaged with the closed loop at that end of the stabilizing line 302. Although, in some embodiments, the aquatic stabilizing locus inhibiting roving may include an anchor, of some form at the stabilizing line, not concatenated to the main body 102, the aquatic stabilizing locus inhibiting roving may stabilize the locus and prevent aquatic roving without any integral or integrated anchor component. The aquatic stabilizing locus inhibiting roving may not require incorporating manufacture of an anchor, or incorporating manufacture for storage, transport, or upkeep of an anchor for the aquatic stabilizing locus inhibiting roving to function. The end of the stabilizing line 302 that is not concatenated to the water side 210 attachment loop 108 may be linked onto any common object 304 an aquatic recreationist may bring to or find at the water's edge, which may be a retaining vessel, that can be filled in order to, or will as it is, remain on the water's floor, such as but not limited to: a canvas or vinyl shopping or beach bag, a bucket or beach pail, a boat anchor, an exercise dumbbell, a cooler, a tent bag, backpack, an athletic equipment bag, or any object 304 available to the aquatic recreationist that can be filled with sand, mud, rocks, logs, or any available item 306 that will weigh down the object so that it remains on the water's floor. As an example, the aquatic recreationist may fill the object 304 using their hands, or with the aid of a shovel or scoop such as, but not limited to, may be used in an ice machine. The object 304 linked to the stabilizing line 302 may be sealable, such as but not limited to a zippered, snapped, or Velcro type sealed vinyl bag, but need not be sealable so long as the water state allows the object 304 to retain the inserted material that is weighting it down. Thus, the stabilizing line 302 may facilitate stabilization of the main body 102 without need for use of any preexisting fixed structure in the water or near its edge. The concatenation element 110 at the end of the stabilizing line 302 that is not linked to the main body 102 water-side 210 attachment loop 108 may also link the stabilizing line 302 onto or around any fixed feature in the water or near the water's edge (not shown in FIG. 3). As a nonlimiting example, such a fixed feature may include a pole, anchored netting or buoyed cables as may border a designated swimming or protected area, or any anchored object such as but not limited to a watercraft, diving platform, or buoy.

As a nonlimiting example, in operation, an aquatic recreationist may carry the aquatic stabilizing locus inhibiting roving to the edge of a body of water, fill some sort of object 304, serving as a retaining vessel, with naturally abundant and weighty material, such as but not limited to sand, mud, rocks, or a log, link the object to the concatenation element 110 at the end of the stabilizing line 302 that is not connected to the water side 210 attachment loop 108 on the main body 102, carry the main body 102 and the object 304 to the desired location in the water, and release the object 304 to settle on the floor of the body of water. The aquatic stabilizing locus inhibiting roving may function to service individual or multiple personal flotation devices, but the aquatic stabilizing locus inhibiting roving may be manufactured independent of any such devices. The aquatic stabilizing locus inhibiting roving may serve to stabilize and prevent aquatic roving of any floating item in concatenation with it, such as, but not limited to, several canoes or recreational watercraft.

Now looking at FIG. 4, a plan view drawing 4A, looking down upon a top, sky-side 104, of a manufacture of an embodiment of an aquatic stabilizing locus inhibiting roving , and a cross-section drawing 4B of a side elevation of a portion of the same main body 102 are shown. In some embodiments, the main body 102 may be formed with at least one sealed compartment 402 accessible through at least one sealed lid 404 on the top, sky-side 104, of the main body 102, which seal may be impenetrable by water. In some embodiments, the main body 102 may be formed with at least one open compartment 406 formed within the main body 102, which may be open to and accessible from the top, sky-side 104, of the main body 102.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

The invention claimed is:

1. We claim an apparatus, the apparatus being an aquatic stabilizing locus-configured to inhibit an object from roving in an aquatic environment, the aquatic stabilizing locus comprising:

a main body configured to be buoyant in water, the main body comprising:

a top surface, such that the top surface is exposed to a sky;

a bottom surface, such that the bottom surface is exposed to a body of water;

an attachment loop base configured to secure an attachment loop on the top surface of the main body, the attachment loop base being a reinforced area connected to the top surface of the main body, and the attachment loop configured to connect an object to the ton surface of the main body;

a water-side attachment loop secured to a water-side attachment loop base, the water-side attachment loop base being located on the bottom surface of the main body; and a stabilizing line, such that the stabilizing line comprises:

a first end, and a second end, the first end and the second end each formed respectively into respective fixed loops, each fixed loop configured to concatenate with at least one concatenation element respectively, the first end being concatenated to the water-side attachment loop by a first concatenation clement.

2. We claim the apparatus of claim 1, further comprising at least one surface of the main body being resistant to at least one effect from a group of effects comprising: corrosion, and deterioration, in an environment comprising at least one characteristic from a group of characteristics comprising: aqueous, saline, and solar radiation.

3. We claim the apparatus of claim 1, wherein at least one surface of the main. body displays at least one color from a group of colors comprising: a sea rescue orange color, and a color configured to visually distinguish the main body from an object near the main body.

4. We claim, the apparatus of claim 1, wherein the main body further comprises at least one receptacle.

5. We claim, the apparatus of claim 1, wherein the main body further comprises at least one compartment.

6. We claim, the apparatus of claim 5, wherein the compartment comprises a sealable lid.

7. We claim, the apparatus of claim 6, wherein the sealable lid comprises: a lid, and a seal, the lid, and the seal, each being water impermeable.

8. We claim, the apparatus of claim 1, wherein the top surface of the main body comprises an adhesion zone configured to retain an item to the top surface of the main body.

9. We claim, the apparatus of claim 8, wherein the item comprises at least one item from a group of items comprising: a decorative item, an identifying item, a protective item, an entertainment item, an advertising item, a communication item, and a rescue item.

10. We claim the apparatus of claim 1, wherein, the main body comprises at least one device from a group of devices comprising: a Global Positioning Satellite tracking device, and a Global Positioning Satellite signaling device.

11. We clam the apparatus of claim 1, further comprising a second concatenation element concatenated to the second end of the stabilizing line.

12. We claim the means for inhibiting roving of claim 1, further comprising a means to store objects upon the stabilizing locus.

13. We claim the means for inhibiting roving of claim 1, further comprising a means for making the locus uniquely identifiable and plainly visible in the aquatic medium.

14. We claim a method of inhibiting roving of a first object in a body of water, the first object being a personal floatation device concatenated to the stabilizing locus, such that the stabilizing locus comprises: a main body configured to be buoyant in water, the main body comprising: a top surface, such that the top surface is exposed to a sky; a bottom surface, such that the bottom surface is exposed to the body of water; an attachment loop base configured to secure the attachment loop to the main body, the attachment loop base being a reinforced area connected to the top surface of the main body, and the attachment loop configured to connect an object to the top surface of the main body; a water-side attachment loop secured to a water-side attachment loop base, the water-side attachment loop base being located on the bottom surface of the main body; and a stabilizing line, such that the stabilizing line comprises: a first end, and a second end, the first end and the second end each formed respectively into respective fixed loops, each fixed loop configured to concatenate with at least one concatenation element respectively, the first end being concatenated to the water-side attachment loop by a first concatenation element, concatenating a stabilizing locus to a second object, such that the location of the second object remains substantially stationary relative to a body of water, the stabilizing locus floating in the body of water; and concatenating the first object to the stabilizing locus via an attachment loop on the top surface of the main body.

15. The method of claim. 14 further comprising concatenating the stabilizing locus to the second object via a stabilizing line.

16. The method of claim 14 further comprising the second object being a retaining vessel.

17. The method of claim 16 further comprising receiving and retaining in the retaining vessel, a third object that causes the retaining vessel to settle on a floor of the body of water.

18. The method of claim 17 further comprising the third object being at least one object in a group of objects comprising: a sand, and a soil, the third object originating from a location in a group of locations comprising: in the body of water, and adjacent to the body of water.

* * * * *